US006107972A

United States Patent [19]

Seward et al.

[11] Patent Number: 6,107,972

[45] **Date of Patent: *Aug. 22, 2000**

[54] MULTIBAND ANTENNA SYSTEM

[75] Inventors: Glen J. Seward, Cincinnati, Ohio; Paul E. Miller, Spring Lake, Mich.

[73] Assignee: R.A. Millier Industries, Inc., Grand Haven, Mich.

[ * ] Notice: This patent issued on a continued prosecution application filed under 37 CFR 1.53(d), and is subject to the twenty year patent term provisions of 35 U.S.C. 154(a)(2).

This patent is subject to a terminal disclaimer.

[21] Appl. No.: 08/929,142

[22] Filed: Sep. 10, 1997

Related U.S. Application Data

[63] Continuation of application No. 08/615,607, Mar. 13, 1996, Pat. No. 5,734,352, which is a continuation-in-part of application No. 08/452,079, May 26, 1995, abandoned, which is a continuation of application No. 08/092,508, Jul. 16, 1993, abandoned, which is a continuation-in-part of application No. 07/926,905, Aug. 7, 1992, abandoned.

[51] Int. Cl.[7] ..... H01Q 1/00

[52] U.S. Cl. ..... 343/722; 343/715; 343/749

[58] Field of Search ..... 343/895, 722, 343/749, 715, 858, 900; H01Q 1/00, 1/36, 9/00

[56] References Cited

U.S. PATENT DOCUMENTS

| | | | |
|---|---|---|---|
| 3,725,942 | 4/1973 | Ukmar | 343/715 |
| 4,085,405 | 4/1978 | Barlow | 343/858 |
| 4,095,229 | 6/1978 | Elliott | 343/715 |
| 4,097,867 | 6/1978 | Eroncig | 343/715 |
| 4,106,025 | 8/1978 | Katz | 343/715 |
| 4,117,493 | 9/1978 | Altmayer | 343/750 |
| 4,141,016 | 2/1979 | Nelson | 343/858 |
| 4,157,547 | 6/1979 | Freimark et al. | 343/858 |
| 4,222,053 | 9/1980 | Newcomb | 343/722 |
| 4,229,743 | 10/1980 | Vo et al. | 343/749 |
| 4,404,564 | 9/1983 | Wilson | 343/750 |
| 4,940,989 | 7/1990 | Austin | 343/749 |
| 5,057,849 | 10/1991 | Dörie et al. | 343/722 |
| 5,089,829 | 2/1992 | Haruyama et al. | 343/852 |
| 5,258,765 | 11/1993 | Dörrie et al. | 343/722 |
| 5,451,967 | 9/1995 | Ueda et al. | 343/722 |
| 5,734,352 | 3/1998 | Seward et al. | 343/722 |

*Primary Examiner*—Michael C. Wimer

*Attorney, Agent, or Firm*—Rader, Fishman, Grauer & McGarry an office of Rader, Fishman & Grauer PLLC

[57] ABSTRACT

An AM/FM/CB/cellular telephone antenna includes a first frequency self-resonant circuit at a position above the lower end of the antenna such that the electrical length of the lower section of the antenna is equivalent to one-quarter wavelength for a frequency in the FM frequency range and a second frequency self-resonant circuit disposed below the first frequency self-resonant circuit. The first self-resonant circuit presents a high impedance in the FM frequency band and the second self-resonant circuit presents a high impedance in the cellular frequency range. The entire length of the antenna is equivalent to one-quarter wavelength in a frequency in the CB frequency band. The antenna wire is wound around a fiberglass core, and the FM self-resonant circuit is formed by a tightly wound, coiled section of the wire together with a thin-walled brass tube extending over the core in the area of the tightly wound section. A thin dielectric film is applied between the tube and the tightly wound section of antenna wire thereby forming a capacitor. There is no direct electrical connection between the antenna wire and the tube, and the capacitance between these elements is essentially only stray capacitance. Two antennas, each comprising two frequency self-resonant circuits, are connected by means of a multiplexing circuit to AM/FM, CB and cellular telephone apparatus.

24 Claims, 3 Drawing Sheets

MULTIBAND ANTENNA SYSTEM

This is a continuation of application Ser. No. 08/615,607 filed Mar. 13, 1996, now U.S. Pat. No. 5,734,352 which is a continuation-in-part of Application Ser. No. 08/452,079, filed May 26, 1995, now abandoned, which is a continuation of Application Ser. No. 08/092,508, filed Jul. 16, 1993, now abandoned, which is a continuation-in-part of Application Ser. No. 07/926,905, filed Aug. 7, 1992, now abandoned.

BACKGROUND OF THE INVENTION

1. Field of the Invention

The invention pertains to antennas and more particularly to multiband antennas for use in the AM/FM/CB and cellular telephone bands.

2. Prior Art

Multiband antennas which simultaneously serve as antennas for AM/FM broadcast radio and for Citizen Band transceivers are known. A problem in designing antennas of this type is to define an antenna which has near optimal receiving/transmission capabilities in several separate frequency bands. The AM radio band falls in the comparatively low frequency range of 550 to 1600 KHz while FM radio operates in the 88 to 108 MHz range and CB operates in the relatively narrow range of 26.95 to 27.405 MHz. Cellular telephone operates in a frequency band of 825 to 890 MHz. It is well known from antenna design principles that a commonly used electrical length for a rod antenna used with a ground plane is one-quarter of the wavelength of the transmitted signal. Thus, there is a design conflict when a single antenna is used for several frequency ranges. One option used in prior art antenna design is to tune the antenna to the separate frequencies when switching between bands. This has obvious disadvantages to the user of the radio, using impedance matching networks. Another option is to design an antenna which provides a compromise and is usable in several frequency bands. Such an antenna, by its nature, provides near optimal reception in at most one frequency range. For example, it is not uncommon in automobile antennas to use an antenna length equivalent to one-quarter wavelength to the midpoint of the FM range. As a consequence, the lower frequency AM reception is not optimum but is acceptable. However, such an antenna is unacceptable for use with a cellular or CB transceiver. Similarly, a CB antenna does not provide adequate FM or cellular reception.

In automobiles and trucks, it is common to use one antenna for CB and another for AM/FM and a third for cellular telephone. Trucks typically use a pair of CB antennas connected in parallel and through a T-connection to the CB radio equipment. The antennas are often mounted on the side view mirrors on both sides of the cab which, because of their location outside of the cab and beyond the sides of the trailer or box behind the cab, provide a favorable signal reception position. It is not feasible, however, to put separate AM/FM, cellular and CB antennas on the mirrors because of space and interference considerations. Consequently, these antennas have typically been placed in various locations on the vehicle with less than satisfactory signal reception or transmission. For example, reception or transmission for FM and cellular telephone antennas mounted on the roof of a truck cab is often blocked by the box of the truck.

A significant problem in multiple antenna systems of the prior art is the mismatch in electrical characteristics between the two separate antennas of a dual antenna system and the mismatch between the antennas and the radio equipment.

Such mismatches result in a loss of power and can cause damage to the radio equipment due to reflected energy. The loss of power is particularly noticeable in fiberglass cabs which lack the standard ground plane.

U.S. Pat. No. 4,229,743 to Vo et al., issued Oct. 21, 1980, discloses a multiband AM/FM/CB antenna having a plurality of resonant frequencies. This prior art antenna uses coil sections wound around portions of the antenna to form a network. The network is used to provide an impedance element having a resonant frequency at approximately 59 MHz. This is an approximate midpoint between the CB and FM band and does not provide optimal reception in the two separate bands.

U.S. Pat. No. 5,057,849 to Dörrie et al. issued Oct. 15, 1991, discloses a rod antenna for multiband television reception. That antenna uses a support rod with two connected windings wound on the rod, one of the windings being spiraled with wide turns and the other being tightly wound. The two windings are capacitively coupled to the antenna connection element by a loop of a third winding. This antenna, when connected to a television receiver, allows the receiver to be switched between UHF and VHF without requiring specific tuning of the antenna. The antenna, however, does not provide optimal reception of two separate frequency bands.

Frequency self-resonant circuits have been used by amateur radio operators to be able to use the same antenna for more than one frequency band. Such known frequency self-resonant circuits customarily consist of a coil in the antenna with a discrete capacitor connected across the coil and external to the coil. Together, the coil and capacitor form an LC circuit which presents a high impedance at a selected frequency to effectively isolate a portion of the antenna at the selected frequency. Such an arrangement with discrete capacitors is not practical for automotive antennas and other applications.

U.S. Pat. No. 4,404,564 to Wilson, issued Sep. 13, 1983, discloses an omni-directional antenna in which the electrically conductive antenna element is wound around a rod of insulating material and a tuning device comprising a hollow cylinder of non-conductive material mounted on the antenna rod and a metallic sleeve around a portion of the cylinder and an outer coil electrically isolated from the sleeve and the antenna conductor. Such an arrangement does not provide the desired frequency band separation.

U.S. Pat. No. 4,22,053 to Newcomb discloses an amateur radio antenna constructed of a plurality of telescoping, overlapping tubular sections. The antenna includes a self-resonant circuit comprising a coiled wire section having opposite ends electrically connected to two different telescoping tubular sections which are electrically insulated from each other. The self-resonant circuit has an inductive component provided by the wire coil and a capacitive component provided by the overlapping tubular sections, with the overlapping tubular sections essentially acting as plates of a capacitor. Such overlapping tubular section antennas work well as stationary antennas but are not acceptable for motor vehicle antennas, particularly where relatively long antennas are required, such as for CB transmission and reception. A problem with such prior art multiband antennas is that the antennas are bulky, have too much wind resistance for use on motor vehicles and are not aesthetically pleasing.

Antennas which serve both for cellular telephone and CB are not generally known among commercially available antennas. The difference in operating frequency between the cellular telephone and CB radio is sufficiently great that the designer of a cellular telephone antenna faces an entirely different set of problems than the designer of a CB antenna. The CB antenna operates in a range where a quarter wavelength is approximately 9 feet while the cellular antenna must operate in a frequency range where a quarter wavelength is approximately 3.3 inches. CB antennas are commonly used on trucks and mounted on side mirrors which are spaced apart by approximately 9 feet, or one-quarter wavelength and the CB range to provide and enhance that radiation pattern. Combining a cellular antenna with a CB antenna at that spacing is more likely to result in a signal cancellation than in signal enhancement. However, a need for a single antenna structure which would serve as an AM/FM/CB/cellular radio antenna has existed for some time. It is recognized that the manufacturer of a single antenna structure is more cost effective both in manufacturer and installation and maintenance on the vehicle than a plurality of antennas. Placement and mounting of plurality of antennas requiring the drilling holes and separate wiring adds to the expense and inconvenience of a proliferation of antennas on a vehicle.

SUMMARY OF THE INVENTION

These and other problems of the prior art are overcome in accordance with this invention by means of a single, continuous antenna wire formed with a plurality of spaced apart coils defining several antennas and effective in various frequency ranges, including the CB and cellular radio frequency range.

An antenna, in accordance with the present invention, comprises an antenna wire and a self-resonant inductor constructed of a plurality of turns of the antenna wire formed into a coiled section. A conductive sleeve is disposed internal to the coiled section and a layer of dielectric material disposed between the conductive material and the coiled antenna wire. In that configuration the metal sleeve serves to reduce the self-resonance of the inductor and helps to control the resonant frequency. The coiled section and the conductive sleeve form a circuit in which only parasitic currents flow. Only a single conductive sleeve is required for the self-resonant circuit and separate electrical connections to the sleeve or the coiled section are not required.

In accordance with one aspect of the invention, an AM/FM/CB/cellular antenna is formed from a solid core wire continuously extending between a terminating end of the antenna, which is connectable to a transmitter/receiver, and a distal end opposite the terminating end. An FM resonant circuit section, disposed one-quarter wavelength in the FM frequency range from a lower end of the antenna, comprises a portion of the antenna wire formed into a multiple-turn coiled section with successive turns disposed immediately adjacent one another and a layer of conductive material disposed internal to the coiled section and spaced apart from the coiled section by a layer of dielectric material. The adjacent turns of the coiled section together act as a plate of a capacitor and the sleeve forms another plate of the capacitor. The self-resonant inductor provides a high impedance in the FM frequency range. The impedance has an inductive component provided by successive turns of the coiled section and a capacitive component provided by stray capacitance between the layer of the conductive material and the successive turns of the coiled section. A cellular resonant circuit section, disposed three-quarter wavelength in the cellular frequency range from the lower end of the antenna, provides high impedance to signals in the cellular telephone frequency range, thereby defining a cellular telephone antenna in the lower portion of the antenna. A further coiled section, forming a phase inversion coil, is disposed one-quarter wavelength in the cellular frequency range from the lower end of the antenna. The full length of the antenna is available as a CB and AM antenna.

The antenna wire is preferably wound around a solid, non-conductive core with successive turns of the wire being spaced apart in the areas above and below the resonant sections and wound immediately adjacent each other in the resonant circuit sections.

In one particular embodiment of the invention, the conductive sleeve, in the form of a cylindrical tube, extends over a section of the core and the dielectric material extends over the tube such that the tightly wound coiled section is wound around the section of the core occupied by the sleeve and is separated from the sleeve by the dielectric material. The metal sleeve acts to reduce the self-resonance of the inductor and helps to control the resonant frequency at a predetermined value.

Advantageously, the self-resonant circuit in accordance with this invention is easy to manufacture. The wire may be wound around a nonconductive core of fiberglass or other like material. The conductive sleeve and the layer of dielectric material are positioned in the core prior to winding the wire around the core. The wire is continuously wound around the core at various numbers of turns per unit length over the length of the core.

Advantageously, the self-resonant circuit in accordance with the invention does not require any screws or other fasteners which extend into the core and introduce stress points in the fiberglass core.

One embodiment of the invention, a multiband radio antenna system comprises a pair of spaced apart rod antennas each comprising a conductive antenna wire including self-resonant circuit at the cellular telephone frequency and a self-resonant circuit at the FM frequency. Each self-resonant circuit is comprised of a coiled section with the FM section having a layer of conductive material disposed internal to the coiled section and a layer of dielectric material disposed between the layer of conductive material and the antenna wire. A multiplexer circuit is provided to couple the pair of antennas to cellular telephone equipment, an AM/FM radio and a CB radio. In one specific embodiment of the invention, the antennas have an overall electrical length equivalent to a quarter wavelength within the CB range and the FM and cellular resonant sections in each antenna are positioned at an electrical distance from one end of the antenna equivalent to a quarter wavelength for a frequency falling in the FM frequency range and three-quarter wavelength in the cellular telephone range, respectively.

The two spaced apart antennas preferably each have windings in the corresponding sections of the two antennas which are substantially identical in angular dimension and in spacing. Advantageously, such substantially identically wound sections provide substantially identical matching electrical characteristics for the two antennas, thereby significantly increasing the gain of the two-antenna system over mismatched antennas.

In one embodiment of the invention, a pair of the antennas is electrically connected to a CB transceiver, a cellular telephone transceiver and an AM/FM radio through a multiplexer circuit. In one particular embodiment of the invention, the multiplexer is further provided with isolation circuitry operative in the cellular frequency band to isolate one of the pair of antennas from cellular frequency signals from the other antenna. The isolation circuitry may be used to overcome interference negatively affecting the signal pattern, which may occur at cellular telephone frequencies when the two antennas are spaced apart by certain distances.

BRIEF DESCRIPTION OF THE DRAWING

An illustrative embodiment of the invention is described below with reference to the drawing in which.

DETAILED DESCRIPTION

Figure 1:
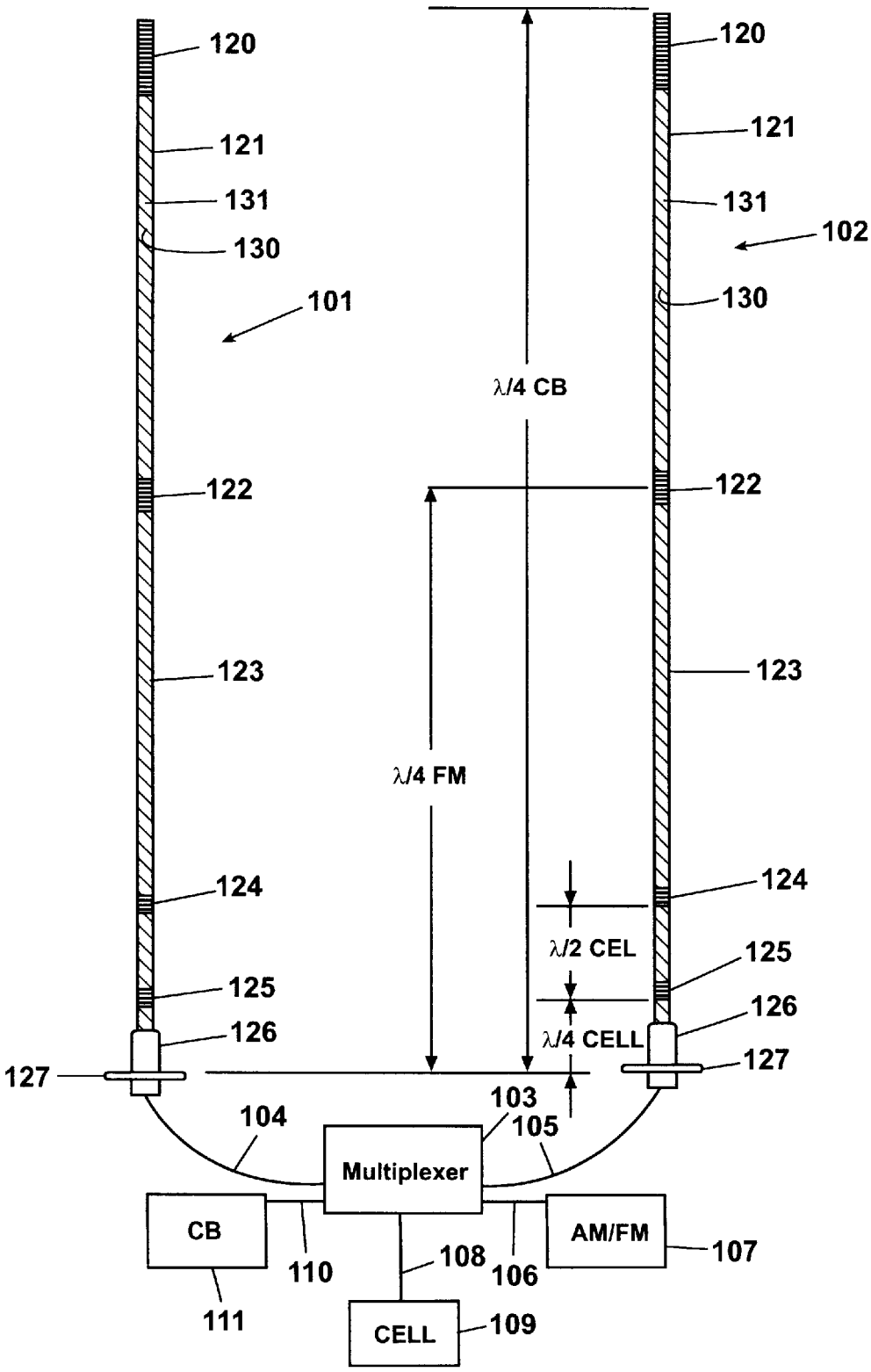
FIG. 1 is a diagrammatic representation of a dual CB/AM-FM/cellular telephone antenna system incorporating the principles of the invention.

FIG. 1 shows an antenna system 100 comprising a pair of identical antennas 101, 102. The antennas 101, 102 are connected to a multiplexer 103 via conductors 104, 105, respectively. The multiplexer 103 serves to connect the antennas to an AM/FM receiver 107 via conductor 106, to cellular telephone equipment 109 via conductor 108 and to a CB transceiver 111 via conductor 110. Each of the antennas is mounted by means of a mounting nut 126 on a bracket 127 which may, for example, be a side mirror mounting bracket of a truck. The overall antenna is preferably on the order of 54 inches in length. The antennas each comprise an enamel coated conductive antenna wire 130 wound around an essentially cylindrically shaped core 131. The core 131 may be a solid core of fiberglass or the like material having a diameter of ¼ inch. The wire of each antenna extend continually from the top of the core 131 to the mounting nut 126 where each antenna is connected to multiplexer 103 via one of the conductors 104, 105. The wire section from the mounting nut 126 to the upper end of the rod 131 has an electrical length of one-quarter wavelength in the CB frequency range. Similarly, antennas are described in Application Ser. No. 08/452,079, filed May 26, 1995, entitled "Multiband Antenna System" which is incorporated by reference herein.

The overall length of the wire 130 includes a tightly wound loading coil 120 at the top of each antenna as well as the wire section 121 extending between the loading coil 120 and an FM self-resonant circuit 122. In the FM self-resonant circuit the successive turns of the wire 130 are immediately adjacent each other. The successive turns of the wire 130 are spaced apart in the area 123 between the FM self-resonant circuit 122 and a cellular self-resonant circuit 124. In the cellular self-resonant circuit 124, as in the FM self-resonant circuit 122, the successive turns of the wire 130 are disposed immediately adjacent each other. The electrical length of the wire section from the mounting nut 126 to the lower end of the FM self-resonant circuit 122 has an electrical length of one-quarter wavelength in the FM frequency range. The wire section between the cellular self-resonant circuit 124 and the mounting nut 126 has an electrical length of three-quarter wavelength in the cellular frequency range. Since the cellular antenna is so short physically compared with either the FM or CB quarter-wave antenna, a phase reversing coil 125 is placed a quarter-wave above the feed and a half-wave below the cellular frequency self-resonant circuit. This allows the current between the phase reversing coil and cellular frequency self-resonant circuit to be in phase with the current on the quarter-wave radiating element between the phase reversal coil and feed point, thus enhancing the antenna gain at cellular frequencies. A phase inverter coil 125 is disposed in the cellular section of the antenna and serves to provide phase inversion, as is common in cellular telephone antennas.

Figure 2:
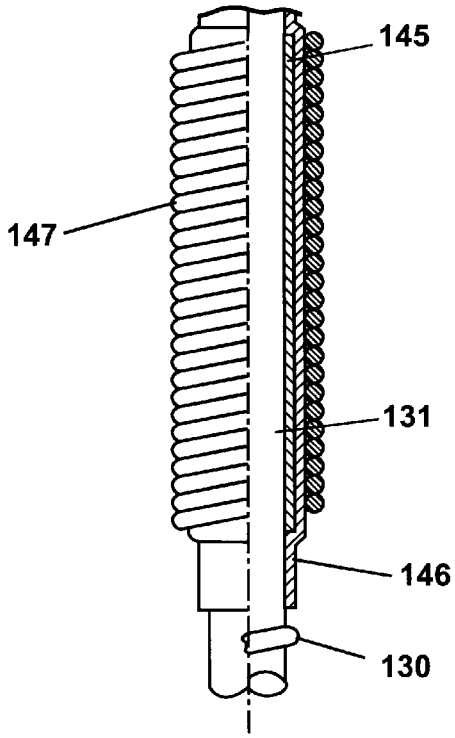
FIG. 2 is a partially cutaway view of a self-resonant circuit in accordance with the invention.

FIG. 2 shows the FM self-resonant circuit 122 in partial cut away. Shown in FIG. 2 is a section of the fiberglass core 131 around which the antenna wire 130 is wound. In the area of the FM self-resonant circuit the antenna wire is wound to form a coiled section 147 with the successive turns of the coil immediately adjacent one another. A thin walled brass tube 145 is extended over the core 131 with its horizontal centerline at the electrical length from the lower end of the antenna equivalent to one-quarter wavelength in the FM frequency range, at approximately 100 MHz. A thin dielectric film 146 is applied over the exterior surface of the tube 145 and the antenna wire 130 is tightly wound over the dielectric film.

Figure 3:
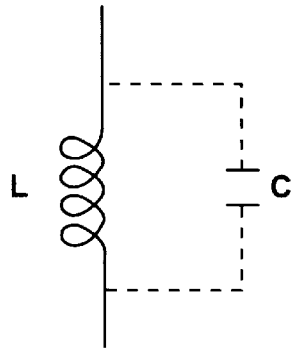
FIG. 3 is an equivalent circuit representation of the self-resonant circuit of FIG. 2.

FIG. 3 shows an equivalent circuit of the FM self-resonant circuit 122 which includes an inductance L introduced by the tightly wound coiled section 147 and a capacitance C resulting from the tube 145 disposed within the coiled section and separated from the coiled section 147 by the dielectric 146. There is no direct electrical connection between the antenna wire 130 and the tube 145 and the capacitance between the antenna wire 130 and the tube 145 is essentially only stray capacitance. For this reason, the connections between the coil L and capacitor C, in FIG. 3, are shown in the form of dotted lines.

An antenna incorporating an FM self-resonant circuit in accordance with the invention may be readily constructed by sliding the metallic tube, having an inner diameter slightly larger than the core, over the core and taping a thin layer of dielectric material over the core prior to coiling the antenna wire on the core. In one particular embodiment of the invention, the brass tube 145 is approximately 2 inches long and has walls which are 0.012 inches thick. The dielectric film in this particular embodiment is a single-layer Kapton® film with a thickness in the range of 0.002 to 0.004 inches. The antenna wire 130 may be a 20-gauge, enamel-coated wire or the like which is tightly wound to form the coiled section 147 with on the order of 35 to 40 turns over the 2 inch length of the tube 145. This arrangement has been found to be self resonating at approximately 100 MHz. The dimensions of the tube and dielectric and the antenna wire as well as the number of turns in the coiled section 147 clearly can be varied and adjusted by one skilled in the art to obtain the resonance at the desired frequency and the above-noted dimensions are provided only as an exemplary embodiment.

Figure 4:
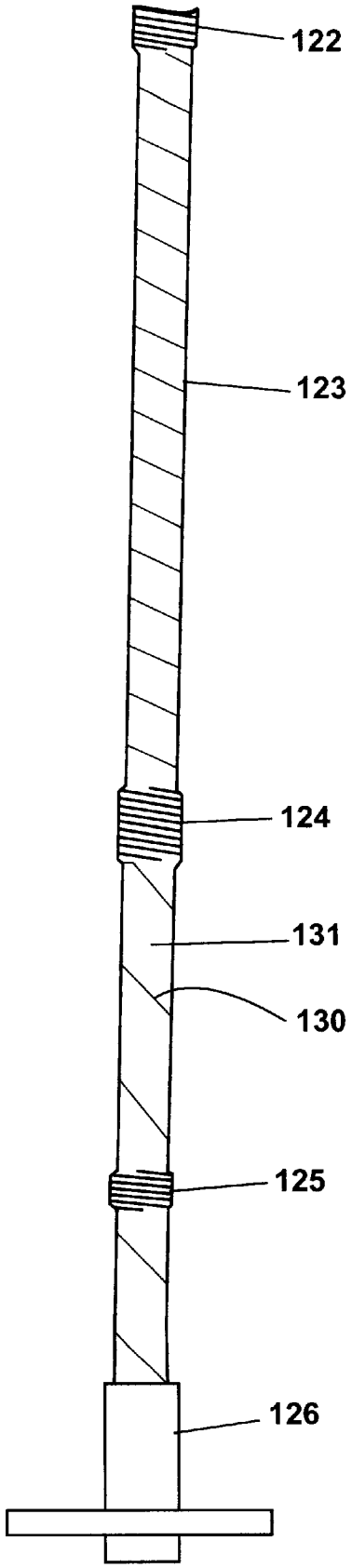
FIG. 4 is an enlarged breakaway view of the cellular telephone portion of one of the antennas of FIG. 1.

FIG. 4 is an enlarged view of the lower section of one of the antennas 101, 102 showing the portion of the antennas below the FM self-resonant circuit 122. Successive turns of the wire 130 below the FM self-resonant circuit 122 is wound around core 131 with approximately three inches per revolution and above the FM self-resonant circuit 130 is wound around the core 131 with approximately 1 to 1.5 inches per revolution. The cellular self-resonant circuit 124 consists of three to five turns of the enamel coated wire 130 with successive turns of the wire disposed immediately adjacent one another and wound on the core 131 without the use of a tubular section and dielectric such employed in the FM self-resonant circuit 122, as shown in FIG. 2. The adjacent turns of the wire 130 in the cellular self-resonant circuit 124 provide sufficient stray capacitance at the cellular frequencies to form an LC circuit which resonates at cellular frequencies. In this manner, the upper portion of the antenna above the cellular self-resonant circuit is isolated from the cellular part of the antenna. Further provided in the cellular section of the antenna is a phase inversion coil 125 consisting of approximately six to eight turns of the wire 130 with adjacent turns of the wire spaced apart by a distance approximately equal to two times the diameter of the wire. The coil 125 performs the same function as a standard phase inversion coil typically employed in a cellular telephone antenna.

To obtain sufficient length for the cellular antenna for appropriate signal reception, the wire 130 in the cellular area could be essentially a straight wire. However, to facilitate manufacturer of the combined cellular AM/FM/CB/cellular antenna, the wire 130 is wound around the core 131 in the cellular area with adjacent windings spaced apart by a convenient distance. In the manufacturing process, the wire 130 is wound around the core 131 while controlling the number of windings per unit length in the various different sections of the antenna. Allowing the wire in the cellular antenna portion to be wound around the core, allows the antenna to be manufactured by a single wire winding operation while varying the pitch of the wire in the various areas on the core. The overall length of the antenna is typically 54 inches. To provide sufficient electrical length of the antenna wire 130 for a quarter wavelength antenna in the CB frequency range, the wire is wound in a loading coil 120.

Figure 5:
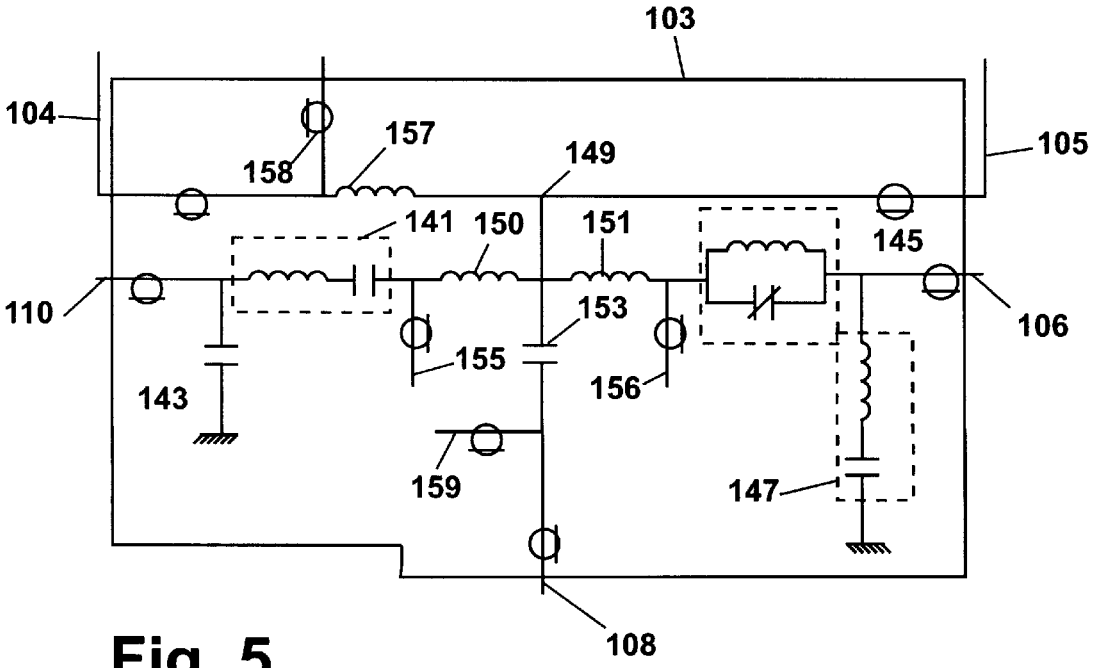
FIG. 5 is a circuit diagram of the multiplexer of FIG. 1.

FIG. 5 schematically shows the circuit of the multiplexer 103 which provides an interface to the CB transceiver 111 via conductor 110, to AM/FM receiver 107 via conductor 106 and to the cellular equipment 109 via conductor 108. The series LC circuit 141 offers a low impedance to the CB signal and a high impedance to the AM/FM signal so as not to load the AM/FM receiver. The parallel LC circuit 145 provides a high impedance at 27 MHz, thereby isolating the CB transmitter from the AM/FM receiver. A pair of coils 150, 151 connected to node 149, at which the antenna conductors 104, 105 are joined, provide high impedance to signals in the cellular frequency range. In this manner, the cellular frequency signals and AM/FM signals are blocked from the CB transceiver 111 and cellular frequency and CB signals are blocked from the AM/FM receiver 107. A capacitor 153 is connected between the node 149 and conductor 108 connected to the cellular telephone equipment 109. The capacitor 153 provides a high impedance at the CB and AM/FM frequencies and a low impedance at the cellular frequencies which isolates the cellular telephone equipment 109 from CB and AM/FM signals. The inductors 150, 151 are self resonant at approximately 850 MHz to maintain a high impedance for cellular telephone frequency signals so as to isolate the cellular signals from the CB and AM/FM radios. The capacitor 153 blocks the lower frequencies from the cellular telephone and offers a low impedance to cellular telephone frequencies when the capacitor is connected in series with an inductor having an inductance of approximately 10 nanohenrys (approximately ½" of standard connection wire). The series LC circuit 147 serves to shunt any CB signal passing through or bypassing the circuit 145 to ground. The capacitor 143 aides in matching the antenna to the CB transceiver 111. The conductors 104, 105, 106, 108 and 110 are preferably coaxial conductors. Referring again to FIG. 5, a coaxial stub 155 is shown connected between the LC circuit 141 and the coil 150. Similarly coaxial stub 156 is shown connected between the coil 151 and the LC circuit 145. The two open, quarter-wavelength coaxial stubs present a low impedance at the cellular telephone frequencies thereby providing additional isolation, if needed. If required, an inductor 157 may be connected between the conductor 104 and the node 149. The inductor 157 is self resonant at cellular telephone frequencies and provides isolation between the two antennas 101, 102 in the event that the antennas are positioned such that interference of cellular signals in the two antennas tends to occur. To provide additional isolation, an open coaxial stub 158 of a quarter wavelength at a cellular frequency, blocking cellular frequency signals, may be connected to the conductor 104 to provide additional isolation. A shorted coaxial stub having an electrical length of one-quarter wavelength of signals in the cellular frequency range provides a low impedance to AM/FM and CB signals to further isolate the cellular radio apparatus from these signals.

What is claimed is:

1. A multiband wire antenna for use with radio apparatus operating in a prescribed lower frequency and a prescribed higher frequency range and having an overall electrical length equivalent to one quarter wavelength of signals in the lower frequency range, the antenna comprising a terminating end connectable to radio apparatus and a distal end opposite the terminating end, a non-conductive flexible solid core longitudinally extending from the terminating end to the distal end, a wire continuously extending between the terminating end and the distal end and wound around the solid core, and a resonant circuit section having a signal blocking impedance for blocking signals in the prescribed higher frequency range, wherein the resonant circuit section comprises a multiple-turn coiled section of the continuously extending wire, a layer of conductive material disposed internal to the coiled section around the solid core and a layer of dielectric material disposed between the conductive layer and the coil;

the resonant circuit section disposed a predetermined distance from the terminating end such that a portion of the wire between the resonant circuit section and the terminating end has an electrical length equivalent to one quarter wavelength of a signal in the prescribed higher frequency range.

2. The antenna in accordance with claim 1 wherein the wire is coated with an insulating material and successive turns of the wire in the coiled section are disposed immediately adjacent each other and in physical contact with each other.

3. The antenna in accordance with claim 1 wherein the layer of conductive material comprises a thin walled tube extending over a section of the solid core and the layer of dielectric material extends over the tube and the wire is wound around the tube and the layer of dielectric material.

4. The antenna in accordance with claim 3 wherein the successive turns of the multiple turn coiled section are disposed immediately adjacent one another and the wire is wound around the core with a plurality of spaced apart turns between the terminating end and the multiple-turn coiled section and between the multiple-turn coiled section and the distal end.

5. The antenna in accordance with claim 4 wherein the distal end comprises a loading coil comprising a plurality of turns of the wire disposed immediately adjacent one another.

6. A multiband radio antenna system for installation on an automotive vehicle and comprising:

a pair of spaced apart antennas each comprising a terminating end connectable to a transmitter/receiver and a distal end opposite the terminating end, each of the antennas having a non-conductive flexible solid core longitudinally extending from the terminating end to the distal end, a wire continuously extending between the terminating end and the distal end and wound around the solid core, and having an overall electrical length equivalent to one quarter wavelength of a frequency in the CB frequency range;

each of the antennas comprising a resonant circuit section disposed a predetermined distance from the terminating end such that a portion of the wire between the resonant circuit section and the terminating end has an electrical length equivalent to one quarter wavelength in the FM frequency range;

wherein the resonant circuit section of each antenna comprises a multiple-turn coiled section of the continuously extending wire, a layer of conductive material disposed internal to the coiled section around the solid core, and a layer of dielectric material disposed between the conductive layer and the coil the resonant circuit section in each of said antennas having a signal blocking impedance at a selected frequency in the FM frequency range defined by an inductive component provided by turns of the respective multiple-turn coiled section in each antenna and a capacitive component provided solely by distributed capacitance between the respective layer of conductive material and turns of the respective multiple-turn coiled section in each antenna.

7. The antenna system in accordance with claim 6 wherein the antennas are matched antennas having substantially identical impedance characteristics.

8. The antenna system in accordance with claim 7 wherein the antennas each comprise a non-conductive, longitudinally extending core of substantially identical dimensions and wherein the wires are coated with an insulating coating and successive turns of each coil are disposed in physical contact with each other.

9. The antenna system in accordance with claim 7 wherein the antennas each comprise a non-conductive, longitudinally extending core of substantially identical dimensions and wherein successive turns of the multiple-turn coiled section of each antenna are disposed immediately adjacent one another and wherein the wire of each antenna is wound around the respective core with a plurality of spaced apart turns between the terminating end of the multiple-turn coiled section of each respective antenna and between the multiple-turn coiled section and the distal end of each respective antenna and wherein the antennas are wound in a substantially identical manner with substantially identical numbers of turns in corresponding sections of each antenna, whereby the antennas are matched to have substantially identical electrical characteristics.

10. The antenna system in accordance with claim 9 wherein the transmitter/receiver comprises CB radio apparatus and FM radio apparatus and a multiplexer circuit for selectively coupling the pair of antennas to the CB radio apparatus and the FM radio apparatus, the multiplexer circuit comprising an input conductor connected to one end of each of the antennas and a first output conductor for connection to the CB radio apparatus, the CB radio apparatus having a predetermined output impedance, and a second output conductor for connection to the FM radio apparatus, the multiplexer circuit further comprising a L-C circuit having an inductor and a first capacitor connected in series between the input conductor and the first output conductor and a second capacitor connected between the first output conductor and system ground, wherein the inductor and the first capacitor have component values so as to form a resonant circuit having a resonant frequency in the CB frequency range and the inductor and the first and second capacitors have component values such that the sum of impedances of the inductor and the first and second capacitors and antennas equal the predetermined output impedance of said CB radio apparatus, the multiplexer further comprising a blocking circuit connected between the input conductor and the second output conductor, the blocking circuit comprising components having component values selected to block signals in the CB frequency range.

11. The system in accordance with claim 10 wherein said components of said blocking circuit comprise a first inductor and a first capacitor connected in parallel between said input conductor and said second output conductor and a second inductor and a second capacitor connected in series between said second output conductor and system ground, said first inductor and said first capacitor of said blocking circuit having component values selected to block frequencies in the CB frequency range and said second inductor and said second capacitor having a component value selected to pass signals in the CB frequency range to system ground.

12. The antenna system in accordance with claim 9 and wherein each of the antennas further comprises a loading coil disposed at the distal end and comprising a plurality of successive turns of the wire wound around the core, and wherein the successive turns of the loading coil of each antenna are disposed immediately adjacent one another.

13. An automotive vehicle antenna having an overall electrical length equivalent to one-quarter wavelength of a frequency in the CB frequency range, the antenna comprising a terminating end of the antenna connectable to transmitter/receiver apparatus and a distal end opposite the terminating end, the wire antenna being formed from a solid core antenna wire extending continuously between the terminating end and the distal end the antenna further comprising:

a first self-resonant circuit section consisting of a first multiple-turn coiled section formed from a first portion of the antenna wire and a layer of conductive material disposed internal to the first multiple-turn coiled section and spaced apart from the multiple-turn coiled section, the first self resonant circuit having a blocking impedance in the FM frequency range;

a second self-resonant circuit section consisting of a multiple-turn coiled section formed from a second portion of the antenna wire spaced apart from the first portion of the antenna wire, the second self-resonant circuit having a blocking impedance in the cellular frequency range;

the first self-resonant circuit section disposed a predetermined distance from the terminating end such that a portion of the antenna wire between the first self-resonant circuit section and the terminating end forms an electrical length equivalent to one-quarter wavelength in the FM frequency range; and the second self-resonant circuit section disposed a predetermined distance from the terminating end such that a portion of the antenna wire between the second self-resonant circuit section and the terminating end forms an electrical length equivalent to three-quarter wavelength in the cellular frequency range.

14. The antenna in accordance with claim 13 and further comprising a longitudinally extending core of non-conductive material and wherein the antenna wire is coated with an insulating material and is wound around the core and successive turns of the antenna wire in the coiled sections are disposed immediately adjacent each other and in physical contact with each other.

15. The antenna in accordance with claim 14 wherein successive turns of the antenna wire in an area between the terminating end and the second self-resonant circuit section are spaced apart by a first predetermined distance and successive turns of the antenna wire in an area between the first self-resonant circuit section and the second self-resonant circuit section and between the first resonant circuit section and the distal end are spaced apart by a second predetermined distance smaller than the first predetermined distance.

16. The antenna in accordance with claim 14 wherein the layer of conductive material comprises a thin-walled tube extending over a section of the core and wherein the layer of dielectric material extends over a thin-walled tube and the antenna wire in the first self-resonant section is wound around a thin-walled tube and a layer of dielectric material.

17. The antenna in accordance with claim 14 wherein the distal end comprises a loading coil comprising a plurality of turns of the antenna wire disposed immediately adjacent one another.

18. The antenna in accordance with claim 13 and further comprising a layer of dielectric material disposed between the first multiple-turn coiled section and said layer of conductive material.

19. A multiband radio antenna system for installation on an automotive vehicle comprising a pair of spaced apart antennas each comprising a non-conductive, longitudinally extending core and each having a terminating end connectable to transmitter/receiver apparatus and a distal end opposite the terminating end, each of the antennas being formed from a solid core antenna wire wound around the non-conductive core and extending between the terminating end and the distal end and forming an antenna having an overall electrical length equivalent to one-quarter wavelength of a frequency in the CB frequency range, each of the antennas further comprising:

a first self-resonant circuit section consisting of a portion of the antenna wire formed into a multiple-turn coiled section and a layer of conductive material extending around the core and disposed internal to the multiple turn coiled section and spaced apart from the multiple-turn, coiled sections the first self-resonant circuit section having a signal blocking impedance at a selected frequency in the FM frequency range the first self resonant section disposed a first predetermined distance from the terminating end such that a portion of the antenna wire between the first resonant circuit section and the terminating end forms an antenna having an electrical length equivalent to one-quarter wavelength in the FM frequency range;

a second self-resonant circuit section having a signal blocking impedance in the cellular telephone frequency range and consisting of turns of the antenna wire wound around the core and disposed a second predetermined distance from the terminating end such that a portion of the antenna wire between the second self-resonant circuit section and the terminating end forms an antenna having an electrical length equivalent to three-quarter wavelength in the cellular frequency range.

20. The antenna system in accordance with claim 19 wherein the antennas are matched antennas having substantially identical impedance characteristics.

21. The antenna system in accordance with claim 20 wherein the antennas each comprise a non-conductive, longitudinally extending core of substantially identical dimensions and wherein the antenna wires are coated with an insulating coating and successive turns of each coiled section are disposed immediately adjacent each other.

22. The antenna system in accordance with claim 21 wherein the antennas each comprise a non-conductive, longitudinally extending core and wherein successive turns of the multiple-turn coiled section of each antenna are disposed immediately adjacent one another and wherein the antenna wire of each antenna is wound around the respective cores with a plurality of spaced apart turns between the terminating end of the multiple-turn coiled section of each respective antenna and between the multiple-turn coiled section and the distal end of each respective antenna and wherein the antennas are wound in a substantially identical manner with substantially identical numbers of turns in corresponding sections of each antenna, whereby the antennas are matched to have substantially identical electrical characteristics.

23. The antenna system in accordance with claim 22 and further comprising a phase inversion coil disposed between the terminal end and the second self-resonant circuit section.

24. The antenna in accordance with claim 19 and further comprising a layer of dielectric material disposed between the first multiple-turn coiled section and said layer of conductive material.

* * * * *

UNITED STATES PATENT AND TRADEMARK OFFICE

CERTIFICATE OF CORRECTION

PATENT NO. : 6,107,972
DATED : August 22, 2000
INVENTOR(S) : Seward et al.

It is certified that error appears in the above-identified patent and that said Letters Patent is hereby corrected as shown below:

Title page,
Item [57] -- Replace the text under "ABSTRACT" with the following:
The invention relates to a multi-band antenna that is built on a solid, flexible, non-conductive core. The core extends longitudinally from the terminating end of the antenna, which is connectable to a radio, to a distal end of the antenna. A continuous wire is wrapped around the core, and extends from the terminating end to the distal end. The multi-band antenna is for use in at least two different prescribed frequency bands, and is configured so that the length of the antenna, electrically, is one-quarter wavelenth of a frequency in the lowest frequency band. The antenna further includes at least one resonant circuit section, having a blocking impedance for signals in a higher frequency band, placed along the length of the antenna to create the equivalent of a one-quarter wavelength antenna between the resonant circuit section and the terminating end. The resonant circuit section includes a coiled section of the wire, and a conductive layer wrapped around the core, with a dielectric material in between, whereby the coiled section provides the inductance of the resonant circuit section, and the capacitance of the resonant circuit section is the distributed capacitance between the coiled section and the conductive layer.
Replace "Summary of the Invention," column 3, line 24, through column 5, line 4, with the following:
The invention relates to a multi-band antenna that is built on a solid, flexible, non-conductive core. The core extends longitudinally from the terminating end of the antenna, which is connectable to a radio, to a distal end of the antenna. A continuous wire is wrapped around the core, and extends from the terminating end to the distal end. The multi-band antenna is for use in at least two different prescribed frequency bands, and is configured so that the length of the antenna, electrically, is one quarter wavelength of a frequency in the lowest frequency band. The antenna further includes at least one resonant circuit section, having a blocking impedance for signals in a higher frequency band, placed along the length of the antenna to create the equivalent of a one-quarter wavelength antenna between the resonant circuit section and the terminating end. The resonant circuit section includes a coiled section of the wire, and a conductive layer wrapped around the core, with a dielectric material in between.
In one aspect of the invention, the wire is coated with an insulator, and the coils of the coiled section abut each other. In a further aspect, the conductive layer is a sleeve around the core. A further aspect of the invention includes a loading coil of adjacent turns of the wire at the distal end of the antenna.
An embodiment of the invention is directed to a multiband radio antenna system for installation on a vehicle. The system includes a pair of spaced apart multiband antennas, each antenna having an overall electrical length of on-quarter wavelength in the CB frequency band, and having a resonant circuit section with a signal blocking impedance creating an antenna section having an electrical length of one-quarter wavelength in the FM frequency band. The inductive component of the resonant circuit section is formed It is certified that error appears in the above-identified patent and that said Letters Patent is hereby corrected as shown below:

solely by the coliled section of the wire. The capacitive component of the resonant circuit is formed solely by the distributed capacitance between the conductive layer around the core, and the coiled section of the wire.
A further embodiment of the invention includes multiple antennas being constructed with identical impedance characteristics. A further embodiment includes physically making the antennas so that they have identical physical characteristics as well as impedance characteristiccs.
A further aspect of the invention includes the antenna system being connectable to a transmitter/receiver apparatus including CB and FM radios and a multiplexer for selectively connecting the CB and FM radios to the antenna system and matching the antenna system to the connection impedances of the respective radios.
In a further embodiment of the invention, at least one antenna is provided for use on a vehicle and connectable to a transmitter/receiver apparatus. The antenna has an electrical length equal to one-quarter wavelength in the CB frequency band, and includes first and second self-resonant circuit sections. The first self-resonant circuit section has a signal blocking impedance in the FM frequency band and is spaced from the terminating end, electrically, one-quarter wavelength in the FM frequency band. The second self-resonant circuit section has a signal blocking impedance in a cellular telephone frequency band, and is spaced from the terminating end, electrically, three-quarter wavelength in the cellular frequency band.
In another of its aspects, the invention includes successive turns of the wire around the core being separated by one spacing between the terminating end and the second self-resonant circuit section, and being separated by a different spacing between the second and first self-resonant circuit sections, and between the first self-resonant circuit sections and the distal end. In another of its aspects, the antenna further includes a phase inversions coil between the terminating end and the second self-resonant circuit section.

<u>Column 8, claim 1,</u>
Line 37, delete "coil" and insert therefor -- coiled section --.

<u>Column 9, claim 6,</u>
Line 20, delete "coil" and insert therefor -- coiled section, --.

<u>Column 9, claim 8,</u>
Lines 33-38, replace with text below:
8. The antenna system I accordance with claim 7 wherein the core of each antenna is of substantially identical dimensions and wherein the wires are coated with an insulating coating and successive turns of each coiled section are disposed in physical contact with each other.

UNITED STATES PATENT AND TRADEMARK OFFICE

CERTIFICATE OF CORRECTION

PATENT NO. : 6,107,972
DATED : August 22, 2000
INVENTOR(S) : Seward et al.

It is certified that error appears in the above-identified patent and that said Letters Patent is hereby corrected as shown below:

Column 9, claim 9,
Lines 39-53, replace with text below:
9. The antenna system in accordance with claim 7 wherein the core of each antenna is of substantially identical dimensions and wherein successive turns of the multiple-turn coiled section of each antenna are disposed immediately adjacent one another and wherein the wire of each antenna is wound around the respective core with a plurality of spaced apart turns between the terminating end and the multiple-turn coiled section of each respective antenna and between the multiple-turn coiled section and the distal end of each respective antenna and wherein the antennas are wound in a substantially identical manner with substantially identical numbers of turns in corresponding sections of each antenna, whereby the antennas are matched to have substantially identical electrical characteristics.

Column 11, claim 19,
Line 47, delete "coiled sections" and insert therefor -- coiled section, --.

Column 12, claim 21,
Lines 20-25, replace with the following:
21. The antenna system in accordance with claim 20 wherein the non-conductive, longitudinally extending core of each antenna is of substantially identical dimensions and wherein the antenna wires are coated with an insulating coating and successive turns of each coiled section are disposed immediately adjacent each other.

Column 12, claim 22,
Lines 26-29, replace with the following:
22. The antenna system in accordance with claim 21 wherein the antenna wire of each antenna is wound around the respective cores with a plurality of space apart turns between the terminating end and the multiple-turn coiled section of each respective antenna and between the multiple-turn coiled section and the distal end of each respective antenna and wherein the antennas are wound in a substantially identical manner with substantially identical numbers of turns in corresponding sections of each antenna, whereby the antennas are matched to have substantially identical electrical characteristics.

UNITED STATES PATENT AND TRADEMARK OFFICE

CERTIFICATE OF CORRECTION

PATENT NO. : 6,107,972
DATED : August 22, 2000
INVENTOR(S) : Seward et al.

It is certified that error appears in the above-identified patent and that said Letters Patent is hereby corrected as shown below:

Column 12, claim 23,
Line 42, delete "terminal" and insert therefor -- terminating --.

Column 12, claim 24,
Line 45, delete "first".

Signed and Sealed this

Twenty-seventh Day of November, 2001

*Attest:*

Nicholas P. Godici

NICHOLAS P. GODICI
*Acting Director of the United States Patent and Trademark Office*

*Attesting Officer*

UNITED STATES PATENT AND TRADEMARK OFFICE

CERTIFICATE OF CORRECTION

PATENT NO. : 6,107,972
DATED : August 22, 2000
INVENTOR(S) : Seward et al.

It is certified that error appears in the above-identified patent and that said Letters Patent is hereby corrected as shown below:

Title page,
Item [73] the Assignee should read as follows:

-- [73] Assignee: R. A. Miller Industries, Inc., Grand Haven, Mich. --.

Signed and Sealed this

Nineteenth Day of February, 2002

*Attest:*

*Attesting Officer*

JAMES E. ROGAN
*Director of the United States Patent and Trademark Office*